United States Patent [19]

Chance et al.

[11] 4,367,671

[45] Jan. 11, 1983

[54] CLUTCHED TUNING PEG HANDLE

[76] Inventors: Slim Chance, 100 Eldridge St., Mill Valley, Calif. 94941; William T. Gray, 19612 Grandview Dr., Topanga, Calif. 90290

[21] Appl. No.: 184,702

[22] Filed: Sep. 8, 1980

[51] Int. Cl.[3] ..... G10D 3/14

[52] U.S. Cl. ..... 84/306; 84/458

[58] Field of Search ..... 84/200, 204, 304–306, 84/458, 459

[56] References Cited

U.S. PATENT DOCUMENTS

| | | | |
|---|---|---|---|
| 918,543 | 4/1909 | Haubner | 84/306 |
| 2,601,799 | 7/1952 | Garwood | 81/52. 4 |
| 3,023,658 | 3/1962 | Gusey | 84/306 |
| 3,813,983 | 6/1974 | Paul | 84/458 |

*Primary Examiner*—Lawrence R. Franklin

*Attorney, Agent, or Firm*—Townsend and Townsend

[57] ABSTRACT

An adjustable clutched handle for turning the drive shaft of a tuning peg assembly on a stringed instrument, such as a guitar, is disclosed. The clutched handle includes a tubular handle element having a transverse hole formed perpendicular to the axis of the handle element. A generally tubular adapter sleeve, keyed to the end of the drive-shaft, includes a pair of flat drive surfaces on its outer surface. A pair of pistons, sized for movement along the axial bore, are biased against the drive surfaces by a pair of springs. The springs are held in place against the pistons by an adjustable cap. When a pre-determined tension has been reached, the force of the springs holding the piston against the drive surfaces is overcome to allow the handle to freewheel about the drive shaft.

12 Claims, 3 Drawing Figures

CLUTCHED TUNING PEG HANDLE

BACKGROUND

Stringed instruments, such as pianos, guitars, sitars, banjoes, and so forth must have their strings tightened to the proper tension to be in tune. When tuning pianos a ratcheted wrench, such as disclosed in U.S. Pat. No. 757,878, is often used. However, such ratcheted wrenches merely reposition the turning handle for the convenience of the user. Proper tension is still determined by ear.

Other stringed instruments, such as guitars, have handles as integral parts of their tuning peg assemblies. U.S. Pat. No. 3,813,983 discloses a motor powered string tensioner. This device is designed to ease the chore of manually tightening the tension of this string. However, it still depends upon the user's aural perception to determine when to stop tightening the string. Thus, the user must pluck the string while using the motor driven device and determine, by ear, when the proper tension is reached.

What has not been heretofore available is a device by which the strings on a guitar or other such instrument can be tightened to a pre-determined tension without the need for the tuning by ear presently required. Such a device would allow a musician to quickly and simply retune the instrument during a performance by retightening the strings to a predetermined tension.

SUMMARY OF THE INVENTION

Disclosed is a small and simply constructed adjustable clutched handle which allows the user to tighten guitar strings to a pre-determined tension.

Stringed instruments, such as guitars and banjoes, have their strings wound about a rotatable tuning peg at the end of the neck. The tuning peg is commonly driven through a worm gear arrangement by a handle on a drive-shaft. The strings of the guitar, which are each wrapped about a tuning peg, are tightened by turning a handle on the drive-shaft.

In the present invention the standard handle is replaced by the improved clutched handle. The clutched handle includes a tubular handle element having a transverse hole formed perpendicular to the axis of the handle element. A generally tubular adapter sleeve fits within the transverse hole and is keyed to the drive-shaft of the tuning peg assembly. The adapter sleeve has a pair of flat drive surfaces on its outer surface.

The adapter sleeve is mounted through the transverse bore within the handle element so that the drive surfaces can be aligned with an axial bore in the handle element. A pair of pistons, sized for movement along the axial bore, are biased against opposite sides of the outer surface of the adapter sleeve by a pair of springs. The springs are forced against the pistons by a cap screwed into one end of the axial bore.

The user tightens or loosens the guitar string by rotating the clutched handle about the axis of the transverse bore. When a pre-determined tension has been reached, the force of the springs holding the piston against the drive surfaces is overcome to allow the handle to freewheel about the transverse axis. The chosen string tension can be changed by varying the force of the springs acting upon the piston.

A primary advantage of the present invention is that the user can quickly retune a guitar by tightening the strings to a pre-determined tension with a mere twist of the handle. The "hunting" for the proper tension which presently must be performed in tuning a guitar by ear is eliminated. Thus, the user can accurately tune his instrument during a performance.

The clutched handle of the present invention is both small and simple thus making it inexpensive to produce and easy to use. No large, bulky torque wrenches need be carried around by the user for the handle remains attached to the drive-shaft of the tuning peg assembly.

A separate clutched handle is usually mounted to each tuning peg assembly of the instrument. This allows the player to tailor the tension on each string of the instrument to produce the desired sound. The handle remains conveniently mounted on the drive-shaft of the tuning peg assembly to insure against loss.

The clutched handle of the invention is adjustable so the user can adjust the tension in the strings. This is accomplished by screwing the cap into or out of one end of the axial bore. This changes the amount the springs are compressed to change the force the springs exert against the pistons.

The clutched handle disclosed includes an adapter sleeve keyed to the drive shaft of the tuning peg assembly. By providing an adapter sleeve, several advantages accrue. Different methods of keying the sleeve to the drive shaft, other than the disclosed use of flats within the bore of the sleeve, can be used since the clutch drive surface is on the sleeve and not the drive shaft. Provision of an adapter sleeve allows the clutch drive surface to be of greater diameter to provide more precise control of the tightening force. Further, the sleeve is made from a material, such as nylon or polished aluminum, which can be made to have a very smooth clutch drive surface which wears well. The absence of surface irregularities insures smooth, reproducible operation. If the clutch drive surface ever wears out, the user need only replace the sleeve, an inexpensive part.

Other features and advantages of the present invention will appear from the following description in which the preferred embodiment has been set forth in detail in conjunction with the accompanying drawings.

DETAILED DESCRIPTION OF THE PREFERRED EMBODIMENT

Figure 2:
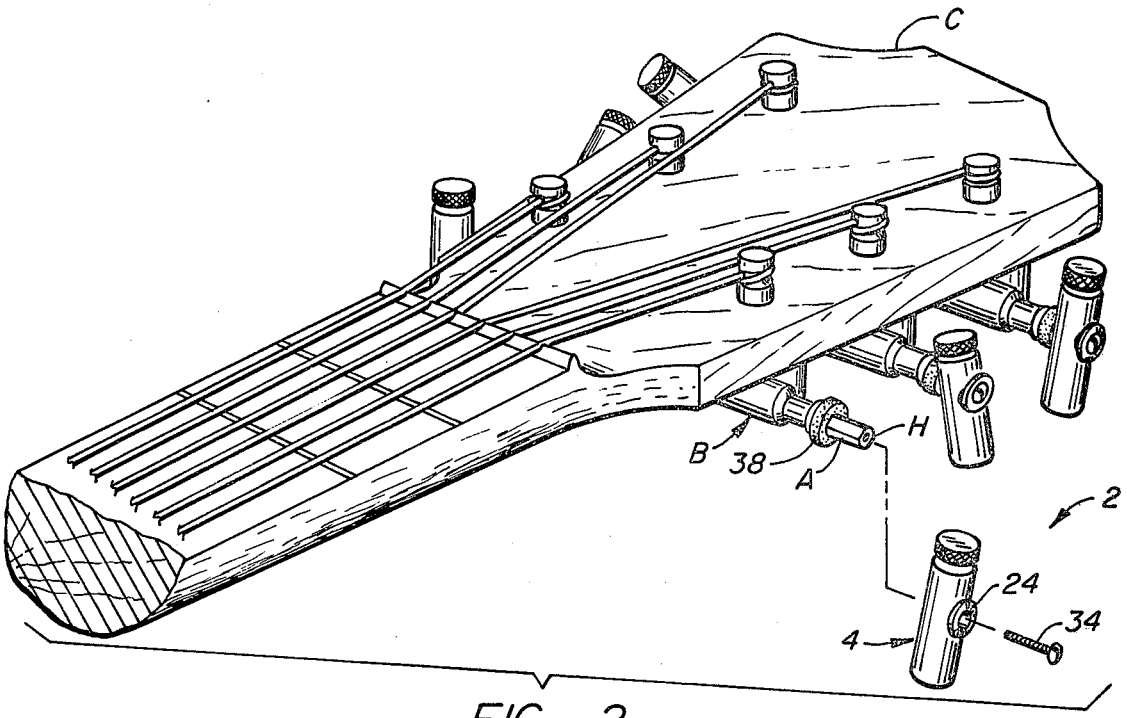
FIG. 2 is a perspective view of the tuning head of a guitar disclosing clutched handles mounted on each drive shaft.
Figure 1:
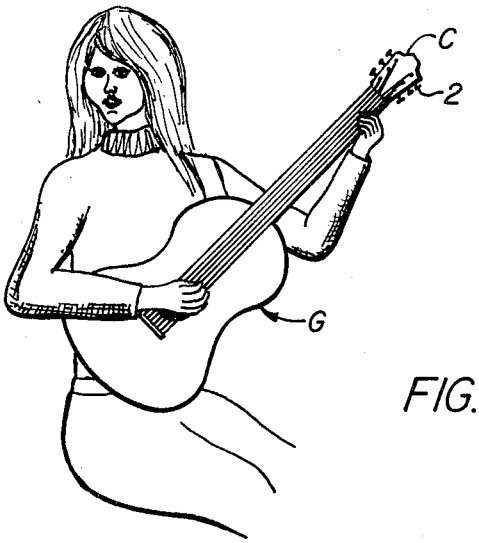
FIG. 1 shows a musician playing a guitar having the clutched handles of the invention mounted to the tuning peg assemblies.
Figure 3:
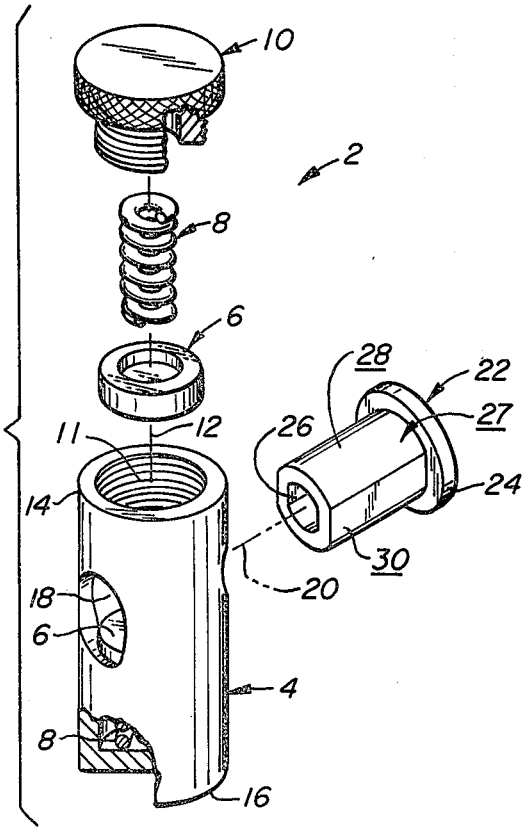
FIG. 3 is a partially exploded isometric view of the clutched handle.

Turning now to the figures, the clutched handle 2 of the present invention includes generally a tubular handle element 4, a pair of pistons 6, a pair of springs 8 and a cap 10.

The tubular handle element has an axial bore 11 along a piston axis 12 extending from first end 14 inwardly through the handle element to near the second end 16. An elongate transverse hole 18 is formed perpendicular to piston axis 12 and defines a drive shaft axis 20.

An adapter sleeve 22 having an outer shoulder 24 and a drive shaft bore 26 formed along drive shaft axis 20 is mounted within transverse hole 18.

The cap is threadably mounted to first end 14 and captures a pair of springs 8 and pistons 6 within the axial bore so that pistons 6 are forced against the clutched drive surface 27 of adapter sleeve 22. The clutched drive surfaces include arcuate portions 28 and a pair of diametrically opposed flats 30. The adapter sleeve is keyed to the drive shaft A of the tuning peg assembly B. Assembly B is mounted to the tuning head C of the guitar G. The clutched handle is fixed to drive shaft A by a screw 34 which threadably engages a threaded hole H within drive shaft A. A washer 38 is also mounted to drive shaft A so that the clutched handle turns more freely on the drive shaft.

Using the clutched handle of the present invention proceeds generally as follows. The user mounts a washer 38 over the drive shaft H of each tuning peg assembly B mounted to the tuning head of the guitar. The clutched handle is then mounted over the drive shaft along drive shaft axis 20 so that the drive shaft is inserted into bore 26 of the adapter sleeve. The handle is then secured to the drive shaft by screw 34. The user then tightens the string until the clutch force of the pistons riding against flat 30 is exceeded so that the pistons move against the springs allowing the handle to free wheel about the drive shaft. The string is then plucked to see if the proper tone is achieved. If the proper tone is not so achieved, the cap is adjusted either increasing or decreasing the force of the spring against the pistons as needed. After each individual clutched handle is so adjusted, when it becomes necessary to retune the instrument by tightening a string, the user merely rotates appropriate clutch handle until it begins to free wheel thus indicating the proper tension has been achieved. No hunting for the proper tension is therefore required.

In the preferred embodiment a single cap has been used to provide an adjustable force by the pistons against the adapter sleeve. If desired two caps could be used, one at each end of the tubular handle element. Also, it should be noted that the transverse hole is an elongate hole, lengthed along piston axis 12. This insures that the adapter sleeve can somewhat float between the two pistons. Other means for changing the force on the pistons could also be used. For example, a number of different springs can be used having different spring constants or different pistons could be provided having different thicknesses to either increase or decrease the force applied against the clutch drive surface of the adapter sleeve.

The clutched handle of the present invention is provided with an adapter sleeve 22 for keyed engagement with drive shaft A. However, if the drive shaft has a suitable clutch drive surface and is of sufficient diameter so that accurate tensioning can be achieved, no adapter sleeve may be needed.

Other modification and variation may be made to the present embodiment without departing from what is regarded as to be the invention.

I claim:

1. A handle for mounting on the rotatable drive shaft of a tuning peg assembly on a stringed musical instrument, such as a guitar, comprising:

an elongate body having a longitudinal axis; and means for mounting said body to said drive shaft transverse to said longitudinal axis, said mounting means including adjustable slip clutch means for applying a chosen torque to said drive shaft by said elongate body so that when said chosen torque is applied to the drive shaft said slip clutch means allows said body to generally free wheel about the drive shaft thereby providing a predetermined tension on the string.

2. A handle for mounting on the drive shaft of a tuning peg assembly on a musical instrument, such as a guitar, comprising:

an elongate body having a longitudinal axis;

means for mounting said body to said drive shaft transverse to said longitudinal axis;

means coupling said body and said drive shaft for adjustably clutchably rotating said drive shaft by said elongate body, said clutchable rotating means including a spring biased piston mounted along said longitudinal axis; and said mounting means including an adapter sleeve fixedly mounted to said drive shaft, said sleeve having an outer, clutched drive surface for engagement with said piston.

3. In combination with a stringed instrument, said instrument having a tuning peg assembly, said assembly including a rotatable tuning peg around which a string of said instrument is wound, a rotatable drive shaft, said drive shaft having a first drive surface, said drive surface including a generally planar portion, and a gear assembly coupling said drive shaft and said tuning peg, an adjustable tuning peg handle comprising:

a handle member having a first bore therein and a second bore transverse to said first bore and in communication therewith, said second bore sized for insertion of said drive shaft therein so that said first drive surface can be aligned with said second bore;

a first piston adapted to move within said first bore;

a first spring sized for placement within said first bore; and a first means for capturing said first spring within said first bore between said first capturing means and said first piston, said first capturing means being adjustably positionable along said first bore to alter the force exerted on said drive shaft and said first drive surface by said first piston.

4. The tuning peg handle of claim 3 further comprising:

said handle member having a third bore coaxial with said first bore and in communication with said second bore;

a second piston adapted to move within said third bore;

a second spring; and a second means for capturing said second spring within said third bore between said second capturing means and said second piston.

5. A tuning peg assembly for use on stringed instruments comprising:

a rotatable tuning peg to which a string is attached;

a rotatable drive shaft;

a gear means coupling said drive shaft and said tuning peg;

a handle mounted to said drive shaft generally transverse to the axis of rotation of said drive shaft, said handle including adjustable slip clutch means for applying a chosen torque to said drive shaft when said drive shaft is rotated by said handle so that when said chosen torque is applied to said handle said slip clutch means allows said handle to generally free wheel about said drive shaft to tighten the string to a tension corresponding to said chosen torque.

6. The tuning peg assembly of claim 5 wherein said slip clutch means further comprises an adapter sleeve mounted to said drive shaft, said sleeve including a clutched drive surface.

7. The tuning peg assembly of claim 6 wherein said drive surface means includes a generally flat surface.

8. The tuning peg assembly of claim 7 wherein said flat surface is generally parallel to the axis of said drive shaft.

9. The tuning peg assembly of claim 7 wherein said slip clutch means includes a spring biased piston carried within said handle for engagement with said clutch drive surface.

10. An improved tuning peg handle for rotating the drive shaft of a tuning peg assembly of a stringed instrument, such as a guitar, comprising:

a generally tubular adapter sleeve adapted for insertion on and nonrotatable engagement with said drive shaft, said sleeve having an external drive surface, said drive surface including a generally planar surface portion;

an elongate handle element having a transverse bore for mounting said adapter sleeve therein; and an adjustable clutch drive means carried within said handle element to engage said planar surface portion so that as said handle element is turned, said drive shaft is rotated by said adapter sleeve until a predetermined tension is reached at which time said clutch drive means disengages from said planar portion to rotatably disengage said handle from said adapter sleeve.

11. A method for adjusting the pitch of a stringed instrument of the type having a tuning peg assembly to which a string is attached, said tuning peg assembly including a drive shaft adapted for rotation by a handle, the method comprising the following steps:

providing and adjustable clutched tuning peg handle mounted to said drive shaft;

adjusting said adjustable handle;

turning said handle to tighten said string until said clutched handle stops rotating said drive shaft;

testing the pitch of said string; and repeating said adjusting, turning, and testing steps until a predetermined pitch is achieved.

12. The adjusting method of claim 11 wherein after said string has lost said predetermined pitch said turning step is repeated to retighten said string to re-reproduce said predetermined pitch.

* * * * *